United States Patent [19]

Wallo

[11] Patent Number: 5,031,285

[45] Date of Patent: Jul. 16, 1991

[54] FOUR-IN-HAND TIE CONTROLLING DEVICES

[76] Inventor: William H. Wallo, 211 S. Myrtle Ave., Clearwater, Fla. 34616

[21] Appl. No.: 509,095

[22] Filed: Apr. 16, 1990

[51] Int. Cl.[5] ..... A41D 25/00

[52] U.S. Cl. ..... 24/49 R; 24/49 CF; 24/49 CP

[58] Field of Search ..... 24/49 R, 49 CF, 49 CP, 24/49 TS, 710.9, 708.8, 708.3, 706.2

[56] References Cited

U.S. PATENT DOCUMENTS

| | | | |
|---|---|---|---|
| 1,524,201 | 1/1925 | Neitzel | 24/49 CP |
| 1,533,702 | 4/1925 | Gerla | 24/49 CP |
| 2,003,740 | 6/1935 | Cohn | 24/49 CF |
| 2,009,911 | 7/1935 | Weinschreider | 24/49 CP |
| 2,040,510 | 5/1936 | Beegle | 24/710.9 |
| 2,044,311 | 6/1936 | Krohmer | 24/49 CF |
| 2,150,351 | 3/1939 | Ashworth | 24/94 TS |
| 2,828,518 | 4/1958 | Robertson | 24/49 CP |
| 3,400,434 | 9/1968 | Pazeotopoulos | 24/49 TS |
| 3,968,544 | 7/1976 | Sinclair | 24/49 CF |
| 4,839,945 | 6/1989 | Price et al. | 24/49 R |

*Primary Examiner*—Victor N. Sakran

*Attorney, Agent, or Firm*—Hill, Van Santen, Steadman & Simpson

[57] ABSTRACT

A controlling device for a four-in-hand tie having a vertical front panel of desired width and a vertical tail portion of substantially less width behind the front panel, comprises a self-sustaining elongated horizontal pin-on or clip-on device loop member for location behind the front panel and of a length about the same as the width of the tail portion and receptive of the tail portion therethrough. The loop member is anchored for retaining the tail portion and the front panel vertically aligned.

10 Claims, 1 Drawing Sheet

FOUR-IN-HAND TIE CONTROLLING DEVICES

BACKGROUND OF THE INVENTION

The present invention relates to new and improved four-in-hand tie controlling devices, and is more particularly concerned with such retainers that are especially useful for maintaining four-in-hand tie parts vertically aligned with one another and/or the front of the user's shirt.

State of the art expedients for attaching the hanging portions of four-in-hand ties to the user's shirt have numerous objections and they fail to provide a truly inconspicuous way to maintain the natural free hanging vertical look of a tie when subjected to various body motions and positions.

Tie clips leave an indentation in the tie and do not permit the tie to hang freely with a natural look. Those clips are also objectionable where the tie may have monogram or raised ornamentation.

Tie pins are objectionable because they do not allow the tie to hang freely with a natural look, and they leave unsightly holes and may damage expensive ties.

While tie chains may control the ties to hang freely, a major objection resides in that the chains are apt to get caught on environmental objects. Further, such chains are liable to damage tie fabrics by virtue of the rubbing action to which the front or tongue panel of the ties are subjected.

Therefore, most tie wearers simply slip the tail of the tie through the opening behind the label attached to the back of the front panel of the tie and then let the thus aligned tie portions swing freely. However, a natural vertically hanging look for the tie is only present when the wearer stands perfectly straight. Since the tie swings with body movement, it is rarely in a natural vertical free hanging position. Further, the swinging motion of the tie puts a strain on the label, causing it to frequently become detached.

SUMMARY OF THE PRESENT INVENTION

An important object of the present invention is to overcome the deficiencies, short comings and disadvantages of prior tie controlling devices.

Another object of the invention is to provide new and improved four-in-hand tie controlling device which provides for inconspicuously maintaining a natural free hanging vertical look of the tie irrespective of various body motions and positions which would otherwise cause the tie to swing out of the free hanging vertical position.

A further object of the invention is to provide tie tail controlling means which cooperates with the usual manner of lacing the tie tail through the horizontal opening behind the label on the back of the front panel of the tie to maintain the hanging parts of a four-in-hand tie in a natural free hanging vertical relation to the shirt front of the user.

Still another object of the invention is to provide new and improved four-in-hand tie controlling devices which can be attached to shirt fronts or can alternatively be used as replacement for the customary tail retaining labels.

Yet another object of this invention is to provide new and improved optional and cooperative forms of tie controlling devices which can be used separately or in conjunction with one another to control the movement and maintain the vertical free hanging look of a free hanging four-in-hand tie.

It is also an object of the invention to provide new and improved tie controlling means which can be inexpensively fabricated from easily obtainable materials so as to be advantageously sold at low cost.

Pursuant to the present invention, there is provided new and improved means for controlling a four-in-hand tie having a vertical front panel of desired width and a vertical tail portion of substantially less width behind the front panel, comprising a self-sustaining elongated horizontal loop member located behind the front panel and of a length about the same as the width of the tail portion of the tie receptive of the tail portion therethrough, and means for anchoring the loop member for retaining the tail portion and the front panel vertically aligned.

There is also provided by the present invention a new and improved method of making and using such a tie controlling means.

BRIEF DESCRIPTION OF THE DRAWINGS

Other objects, features and advantages of the present invention will be readily apparent from the following description of certain preferred embodiments thereof, taken in conjunction with the accompanying drawings, although variations and modifications may be effected without departing from the spirit and scope of the novel concepts of the disclosure, and in which.

DETAILED DESCRIPTION

Figure 1:
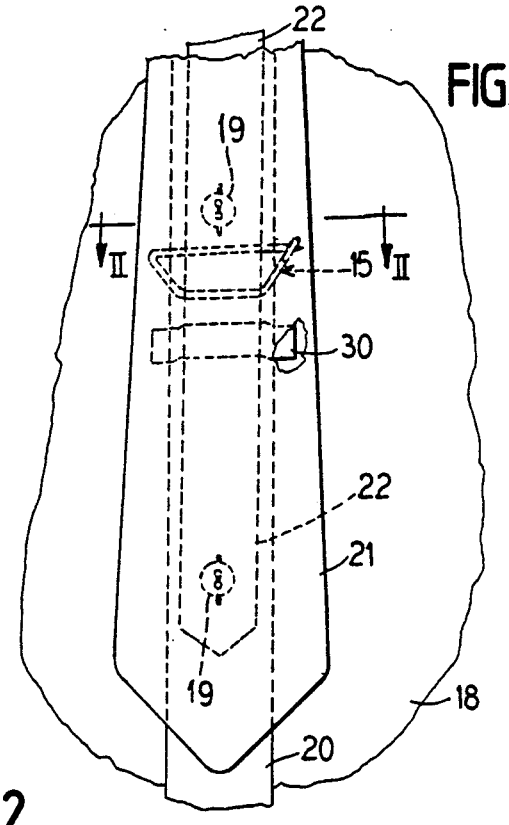
FIG. 1 is a fragmentary elevational view of a shirt front demonstrating use of a pin-on tie controlling device embodying features of the present invention anchored to the shirt front.

A pin-on tie controlling means 15 embodying a best mode structure of the present invention is shown in FIG. 1 inconspicuously maintaining a four-in-hand tie 17 in a natural free hanging vertical appearing mode on a shirt front 18. As is conventional, the shirt front has a front opening which is closed by means of buttons 19 along a marginal reinforcing or button engaging strip 20.

The pin-on device 15 comprises a self-sustaining elongated horizontal loop member for location behind the vertical front panel 21 of the tie 7. Further, the loop of the device 15 is of a length slightly larger than the width of the tail portion 22 of the tie, which is received through the loop. In a preferred construction, the device 15 is formed from wire which may be stainless steel, cold rolled steel, or brass, soft enough for easy forming and hardening to provide a spring temper. In a best mode construction, #302 stainless steel spring tempered straightened wire of about 0.041 diameter and about 3⅞" inch length has been shaped by wire forming techniques to provide a desirably quadrangular loop formation, substantially as shown.

Figure 2:
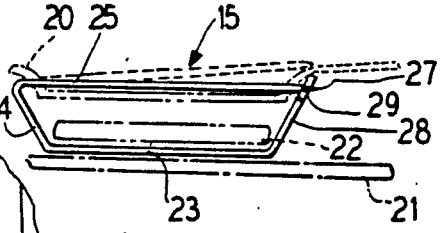
FIG. 2 is a top plan view of the pin-on device shown in FIG. 1.
Figure 3:
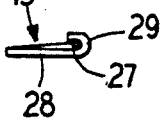
FIG. 3 is an end elevational view looking towards the right in FIG. 2.
Figure 5:
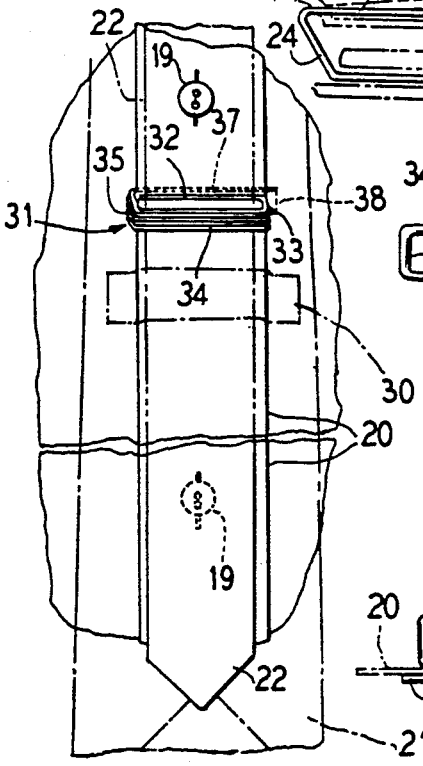
FIG. 5 is a fragmental front elevational view of a shirt front looking through the tie and demonstrating use of a clamp-on form of the present invention.

For advantageously accommodating ties wherein the front panel 21 has a maximum width of about 3" and the narrower tail portion 22 has a width of about 1¼", the pin-on tie controlling loop member device 15 has been effectively provided with a body bar 23 of about 1¼" in length joined on a 120° outside angle (60° inside angle) to a side bar 24 of about ⅜ length which is joined on a 60° outside angle (30° inside angle) to a spring arm 25 of about 1⅝" length and having a precision ground needle tip point 27. At its end opposite to the side bar 24, the body bar 23 is joined at a 120° outside angle (60° inside angle) to a side bar 28 which is of about 7/16" length and provided at its distal end with a return bent catch hook 29 of about ⅛" length and about 1/32" inside width for receiving the pointed tip 27 in latched relation after the spring arm 25 has been pinned to anchor the device 15 in place. It will be observed that in the latched relation of the spring arm 25, the inside angle between the arm 25 and the side bar 28 is 60°. Desirably the spring arm 25 is biased to spring open, that is away from the loop 29 as shown in dash outline in FIG. 2 so as to facilitate pinning of the spring arm 25 to the fabric at the selected site of attachment. As shown in FIGS. 1 and 2, the site of attachment is to the shirt front button hole strip 20, at a location adjacently above, such as ¼" to ½", the customary tie tail receiving label 30 attached to the back of the tie front panel 21.

As readily observed in FIG. 2, the inside dimensions of the quadrangular elongated loop of the device 15 is of ample length and width to accommodate the tie tail 22 freely longitudinally movable therethrough while nevertheless retaining the tie tail to fairly close range of movement in the direction between the body bar 23 and the arm 25, and very limited lateral direction movement between the side bars 24 and 28.

In testing of the device 15, it has been found that the flaring angular relation of the 30° side bars 24 and 28 from the body bar 23, toward the spring arm 25 has the desirable result of permitting free pivoting of the device about the anchored spring arm 25, allowing the tie tail 22 to shift freely longitudinally with body movements of the user, and avoiding skewing of the tie tail at the sides 24 and 28. The 60° inside angle of the sides 24 and 28 prevents the material which the anchoring pin side 25 has been inserted through from creeping up the side 24 or the side 28.

Figure 4:
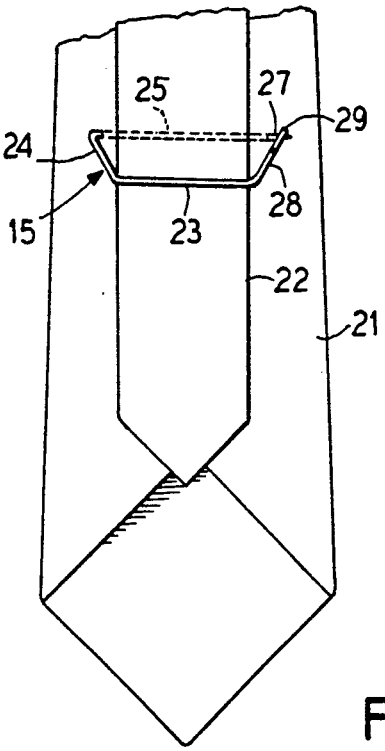
FIG. 4 shows an alternative manner of using the pin-on tie controlling device of FIGS. 1–3 attached to the back of the front panel of a tie.

Advantageously, the pin-on device 15 can in one mode be used for maintaining the tail portion 22 and the front panel 21 vertically aligned by attachment of the pin-on device to the shirt front 18, as in FIG. 1, or, in a second mode as shown in FIG. 4, used as a substitute or replacement for the conventional label 30. In the second mode the pin-on device 15 is pinned onto the back of the front panel 21 of the tie and the tail portion 22 is extended through the loop of the device. This is particularly advantageous for tall persons who have the problem that the tails of their ties are not long enough to reach and be inserted through the customary label 30.

Where a tie has lost the label 30, the pin-on device 15 serves as an excellent substitute. Where for this purpose the pin-on device 15 is carried by the tie as shown in FIG. 4, it can remain with the tie and does not interfere with four-in-hand tying of the tie. Thereby, a person who finds it convenient to use the pin-on device 15 in this fashion on all of his ties may equip each tie with a permanently attached one of the relatively inexpensive pin-on devices 15.

In FIGS. 5-9, a horizontal rectangular loop form, selfsustaining four-in-hand controlling clamp-on device 31 is depicted embodying another best mode structure of the invention and functioning the same as the pin-on device 15 as shown in FIG. 1. Instead of being a pin-on structure, the device 31 is constructed and arranged to be anchored by clip-on attachment to the button hole strip 20 edge of the shirt 18.

To this end, the clip-on device 31 is formed up in a one-piece wireform structure desirably utilizing ribbed round-edge flat wire of about 1/32" thickness and 3/16" width and of any suitable metal which can be annealed and spring hardened as may be needed in the manufacturing process.

Figure 10:
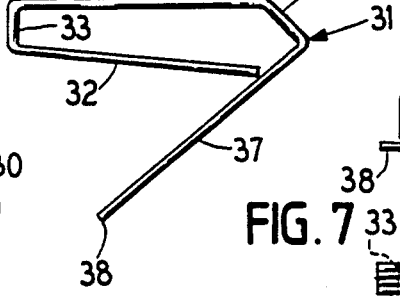
FIG. 10 is a top plan view of the clip-on device of FIG. 6 showing the same in a stage of formation just preceding the final shaping step.

In FIG. 10 are shown four steps of a five-step forming process. The clip-on device 31 is provided with an elongated clamping anvil arm 32 having a preferred inside final form length of 1.360" from distal end to a preform angle of 95° to 98° juncture with a side bar 33 of about 0.218" inside length and joining at a 90° preform angle with an elongated body bar 34 of 1.375" inside length from juncture with the side bar 33 to a preform angle juncture of 135° with a side bar 35 of 0.290" inside length and which joins at a preform angle of 83° to 85° an elongated clamping arm 37 of 1-17/32" inside length. At the end of the preform, the retainer 31 appears as shown in FIG. 10. At this stage in formation of the part it will be observed that both of the arms 32 and 37 are on respective divergent angles relative to the body bar 34 and convergent angles toward one another. This advantageously maintains the arms 32 and 37 spaced apart to facilitate cleaning and finish plating.

In the final shaping step, the clamping arm 37 is brought into parallel contiguous clamping relation to the arm 32 under spring compression. In this relationship, the juncture angle between the arm 32 and the side bar 33 becomes 93°, the juncture angle between the side bar 33 and the body bar 34 remains at 90°, the juncture angle between the body bar 34 and the side bar 35 becomes 90° and the juncture angle between the side bar 35 and the arm 37 becomes 87°. By using this method of forming, there is created a pre-loaded spring tension on the free ends of the arms 32 and 37. This results in parallel continuous clamping action on any of various thicknesses of materials the device 31 is clamped onto, even if only partially inserted.

Figure 6:
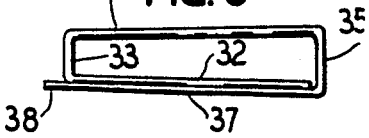
FIG. 6 is a top plan view of the clip-on device of FIG. 5.
Figure 7:
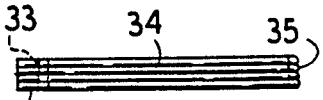
FIG. 7 is an elevational view looking upwardly in FIG. 6.
Figure 8:
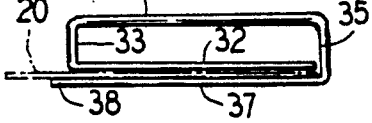
FIG. 8 is a view similar to FIG. 6 showing how tension arms of the clip-on device of FIG. 6 appear when gripping a shirt front

The device 31 as formed up as shown in FIGS. 6, 7 and 8, has the arm 37 projecting at its distal end about 3/32" beyond the radius juncture of the arm 32 with the side bar 33, and serves as a lead-in 38 for receiving the edge of the shirt front button hole strip 20. It will be understood, of course, that the lead-in projection 38 is smoothed off at its free end so as to avoid any catching hang-up in the maneuver onto the shirt front edge.

Figure 9:
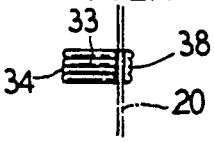
FIG. 9 is an end elevational view looking toward the left in FIG. 8.

As shown in FIGS. 8 and 9, the relative dimensions of the elements of the clip-on device 31 are such that with the shirt front portion 20 gripped between the arms 32 and 37 under spring tension, the arms are sprung apart by the thickness of the material therebetween. This causes the arm 32 to swing slightly inwardly and the arm 37 to swing slightly outwardly and the device 31 assumes a substantially rectangular loop form, wherein the greater length of the arm 35 than the arm 33 cooperates in the squaring up result. Thus, the device 31 will be along its entire length substantially parallel with the engaged portion of the shirt front. This assures maintaining the tie parts substantially parallel to the shirt front and contributes to the desirable, advantageous retention of the front panel 21 and tail portion 22 of the tie in vertical alignment.

In both forms 15 and 31 of the tie controlling device, the overall dimensions of the device relative to the overlying dimensions of the hanging tie parts assures that the device is inconspicuous while efficiently controlling the tie parts as desired and permitting normal free movement, because the tie tail 22 is free to move longitudinally within the loop of the device without skewing or hang-up of the sides of the tie tail within the confining loop which has ample clearance for such movement and retains the tie tail within the desired bounds.

Either of the forms 15 or 31 of the device may be finished as desired for sales or utilitarian purposes. For instance, where the device is provided with a dark coloration inconspicuousness of the device is enhanced. On the other hand, for sales attraction, the device may be provided with more attractive coloration, such as gold, silver or polished brass.

It may be noted that both of the devices 15 and 31 may be used together. For example, where the label 30 has come loose or is missing, one of the pin-on devices 15 can be attached to the back of the tie front 21 to replace the label 30 and its function relative to the tie tail 22. One of the clip-on devices 31 can then be attached to the shirt front above the device 15 for receiving the tie tail 22 and thus cooperate with the associated device 15 in similar fashion as cooperating with the label 30 where that is present.

It will be understood that variations and modifications may be effected without departing from the spirit and scope of the novel concepts of the present invention.

It is claimed:

1. A controlling device for a four-in-hand tie having a vertical front panel of desired width and a vertical tail portion of substantially less width being said front panel for hanging along a shirt front, and comprising:

a self sustaining elongated horizontal member defining a quadrangular loop for location behind said front panel and receptive of said tail portion therethrough;

said member having a body bar of a length about the same as the width of said tail portion;

a first substantially straight side bar extending integrally angularly from one end of said body bar and a second side bar extending integrally angularly from an opposite end of said body bar and projecting in generally the same direction as said first side bar;

said side bars being of substantially the same length and extending in diverging relation to one another at substantially the same angle from said body bar;

a spring arm integrally joined at one end to said first side bar and being movable from a manual sprung-open position extending generally diagonally away from said body bar, into a closed position substantially parallel to said body bar;

a free fabric-penetrating distal end of said spring arm being closingly latchingly engageable with a return bent catch hook on a distal end of said second side bar to close the quadrangular loop of said member, so that when said spring arm is anchored by pinning it into fabric of the tie front panel or of the shirt front, the vertical tail portion of the tie can shift freely longitudinally with body movements of a user of the device and the device is permitted to freely pivot about the anchored spring arm, the inside angle of said side arms at said spring arm preventing material into which the anchored spring arm has been inserted from creeping along the side bars.

2. A device according to claim 1, wherein said body bar is of about 1¼ inch in length joined on a 120° outside angle (60° inside angle) to the side bars which are of about 3/8 inch length joined on a 60° outside angle (30° inside angle) to the closed spring arm which is of about 1⅝ inch length, said catch hood being of about ⅛ inch length and about 1/32 inch inside width.

3. A controlling device for a four-in-hand tie having a vertical front panel of desired width and a vertical tail portion of substantially less width behind said front panel for hanging along a shirt front, and comprising:

a self-sustaining elongated horizontal loop member for location behind said front panel and of a length about the same as the width of said tail portion and defining a loop receptive of said tail portion therethrough;

said loop member having a body bar, a first side bar projecting substantially right angularly from one end of said body bar and a second side bar projecting substantially right angularly from an opposite end of said body bar and substantially parallel in the same direction as said first side bar;

said first side bar having a spring anvil clamping arm projecting toward said second side bar;

said second side bar having an elongated spring clamping arm overlying said anvil clamping arm, and said arms being spring biased toward one another; and said first side bar being shorter than said second side bar by about a shirt front thickness so that when a shirt front is gripped between said clamping arms, the thickness of shirt front material gripped between the arms will compensate for the shorter length of said first side bar and the inside of the loop provided by the device will be substantially rectangular and the tie tail portion extending longitudinally through the loop of the device will be maintained substantially against lateral displacement but freely longitudinally movable within the loop.

4. A device according to claim 3, wherein said anvil clamping arm is of about 1.360 inch in length, said first side bar is of about 0.218 inch inside length, said second side bar is of about 0.290 inch inside length, said body bar is of about 1.375 inch inside length, and said elongated clamping arm is of about 1 17/32 inch inside length.

5. A device according to claim 3, wherein said elongated clamping arm has a lead-in projection extending beyond said first side bar.

6. A device according to claim 3, formed form ribbed flat wire material.

7. A controlling device for a four-in-hand tie having a vertical front panel of desired width and a vertical tail portion of substantially less width behind said front panel and for hanging along a shirt front, and comprising:

a self-sustaining elongated horizontal loop member for location behind said front panel and of a length about the same as the width of said tail portion and receptive of said tail portion therethrough;

means on said member for anchoring said loop member to a shirt front for retaining said tail portion and said front panel vertically aligned;

said anchoring means comprising cooperating straight spring shirt front clamping arms;

said loop member including an elongated body bar having relatively short side bars at its opposite ends connected to and spacing said body bar from said arms; and said side bars being of differential lengths about equal to a shirt front thickness so that when a shirt front is gripped between said arms, a substantially rectangular shape of the loop is attained.

8. A method of making a controlling device for a four-in-hand tie having a vertical front panel of desired width and a vertical tail portion of substantially less width behind said front panel for hanging along a shirt front, and comprising:

forming a self-sustaining elongated horizontal loop member for location behind said front panel and of a length about the same as the width of said tail portion and receptive of said tail portion therethrough;

providing said loop member with a body bar, a first side bar projecting substantially right angularly from one end of said body bar and a second side bar projecting substantially right angularly from an opposite end of said body bar and substantially parallel to and in the same direction as said first side bar;

providing on said first side bar a straight anvil clamping arm projecting toward said second side bar;

providing on said second side bar an elongated straight clamping arm for overlying said anvil clamping bar; and biasing said arms into spring loaded parallel clamping relation for receiving and clamping therebetween a shirt front through substantially their entire length.

9. A method according to claim 7, comprising:

forming said first side bar shorter than said second side bar by about shirt front thickness so that when a shirt front is gripped between said spring clamping arms, the thickness of the shirt front will compensate for the shorter length of said first side bar and the inside of the loop provided by the device will be substantially rectangular and a tie tail portion extending longitudinally through the loop of the device will be maintained substantially against lateral displacement but freely longitudinally movable within the loop.

10. A method of making a controlling device for a four-in-hand tie having a vertical front panel of desired width and a vertical tail portion of substantially less width behind said front panel and for hanging along a shirt front, and comprising:

forming a self-sustaining elongated horizontal loop member for location behind said front panel and of a length about the same as the width of said tail portion and receptive of said tail portion therethrough;

in the forming of said loop member providing it with a body bar, a first side bar projecting substantially from one end of said body bar and a second side bar opposing said front side bar and projecting divergently from an opposite end of said body bar;

providing said first side bar with a resilient anvil clamping arm projecting generally toward said second side bar and extending divergently relative to said body bar;

providing said second side bar with an elongated substantially right angular clamping arm generally overlying said anvil clamping bar, and extending divergently relative to said body bar whereby plating of the thus performed device is facilitated; and finally moving said second side bar into substantially right angular relation to said body bar and thereby moving said elongated clamping arm into substantially parallel continuous clamping engagement with said anvil clamping arm, and placing said anvil clamping arm under spring compression, so that a shirt front can be gripped substantially uniformly between the entire length of said arms.

* * * * *